United States Patent [19]

Astor

[11] 4,098,045

[45] Jul. 4, 1978

[54] WALL FORMING CONSTRUCTION UNIT

[76] Inventor: Edward A. Astor, 1441 NE. 103rd St., Miami Shores, Fla. 33138

[21] Appl. No.: 790,278

[22] Filed: Apr. 25, 1977

Related U.S. Application Data

[63] Continuation of Ser. No. 669,106, Mar. 22, 1976, abandoned.

[51] Int. Cl.[2] ..... E04B 1/32

[52] U.S. Cl. ..... 52/639; 52/690; 52/648; 249/210

[58] Field of Search ..... 52/639, 638, 645, 693, 52/690; 403/170; 249/210, 211

[56] References Cited

U.S. PATENT DOCUMENTS

| | | | |
|---|---|---|---|
| 584,640 | 6/1897 | Kaufman et al. | 52/639 |
| 1,448,854 | 3/1923 | Martin | 52/645 |
| 1,506,987 | 9/1924 | Miller | 403/170 |
| 2,177,043 | 10/1939 | Moths | 52/693 |
| 2,288,365 | 6/1942 | Moths | 249/210 |

FOREIGN PATENT DOCUMENTS

| | | | |
|---|---|---|---|
| 1,361,608 | 7/1974 | United Kingdom | 52/648 |

*Primary Examiner*—James L. Ridgill, Jr.

[57] ABSTRACT

A wall forming unit for use in constructing buildings which unit includes a plurality of commonly oriented, spaced truss members which are spanned by a grid which includes an outer forming surface so that when pairs of the units are arranged with their respective forming surfaces in confronting relation there is defined a space between the forming surfaces to receive a pour of concrete to form a wall; for relatively tall walls, extension trusses are provided.

7 Claims, 15 Drawing Figures

WALL FORMING CONSTRUCTION UNIT

This application is a continuation of application Ser. No. 669,106 filed Mar. 22, 1976, now abandoned.

FIELD OF THE INVENTION

This invention relates to a construction of buildings, and, more particularly, to a wall forming unit and components therefor which are adapted for use in pouring a wall of concrete.

BACKGROUND OF THE INVENTION

In the past, there have been numerous types of forming materials utilized in the construction industry. This invention is of an improved wall construction unit which includes a plurality of parallel trusses in spaced relation defining a support surface to receive a grid which has an outer skin or forming surface carried by it in spanning relation of the trusses and which wall units are adapted to be braced into vertical relation defining a pour zone for concrete so that a wall of concrete can be poured readily.

It is an object of this invention to provide an improved wall pouring unit and components therefor which is constructed of sturdy materials which are assembled in a simple manner, are lightweight, preferably of aluminum, and economical in use for forming walls or surfaces. The walls may be either eight foot or twelve foot walls or combinations to adjust for varying heights walls. Couplers are provided to interconnect the components of the units and to provide for safe walkways for workmen with guardrails to avoid injury in falling. The unit may be manufactured and reused at different job sites and are adapted for a high rate of pour at construction sites.

In accordance with these and other objects which will become apparent hereinafter, the instant invention will now be described with reference to the accompanying drawings in which:

DESCRIPTION OF THE PREFERRED EMBODIMENT

Figure 1:
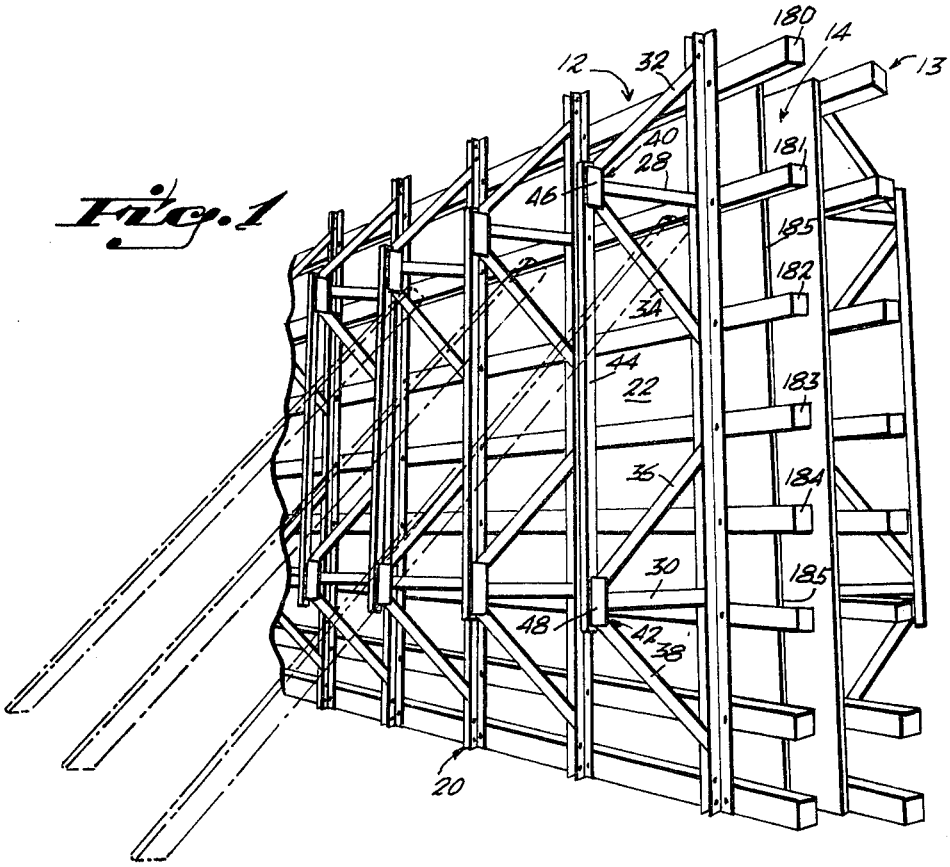
FIG. 1 is a perspective view of the instant invention.
Figure 2:
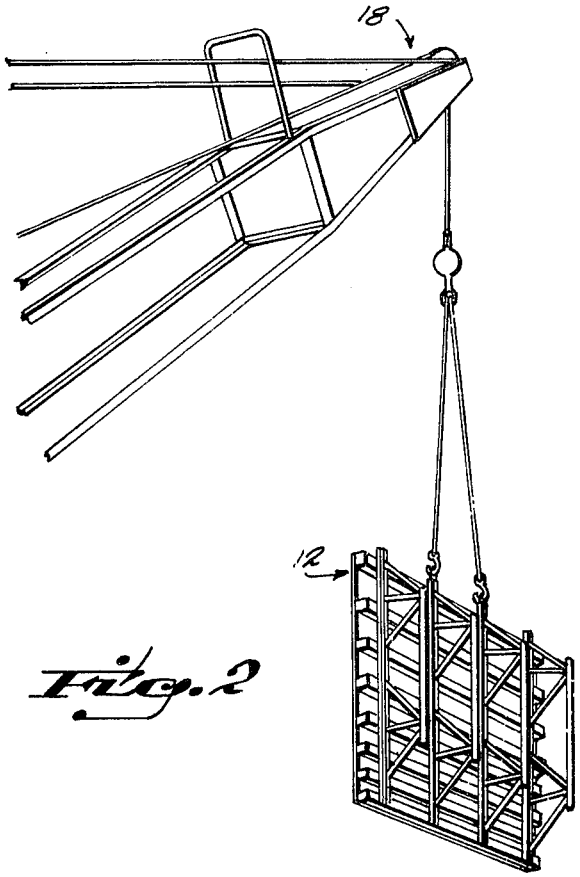
FIG. 2 is a perspective view illustrating use of the instant invention.

Referring to FIG. 1, two wall construction units 12 and 13 are shown in spaced parallel relation defining or forming a pour space 14 between them for flowable building materials, such as concrete. In use, the ends of the pour space between the units are closed by separate pieces. As shown in FIG. 2, the units are adapted to be positioned as required at a job site by use of a crane 18. Once installed for a pour, braces, shown in dotted lines in FIG. 1, may be used.

The basic units each include a plurality of generally similarly constructed truss-like structures interconnected by a support structure to form a skeletal framework 20 in which the truss-like structures are arranged in spaced parallel aligned relation and spanned by a panel structure 22, see FIG. 1.

Figures 3, 4, 5, 6, 7, 8, 9, 10:
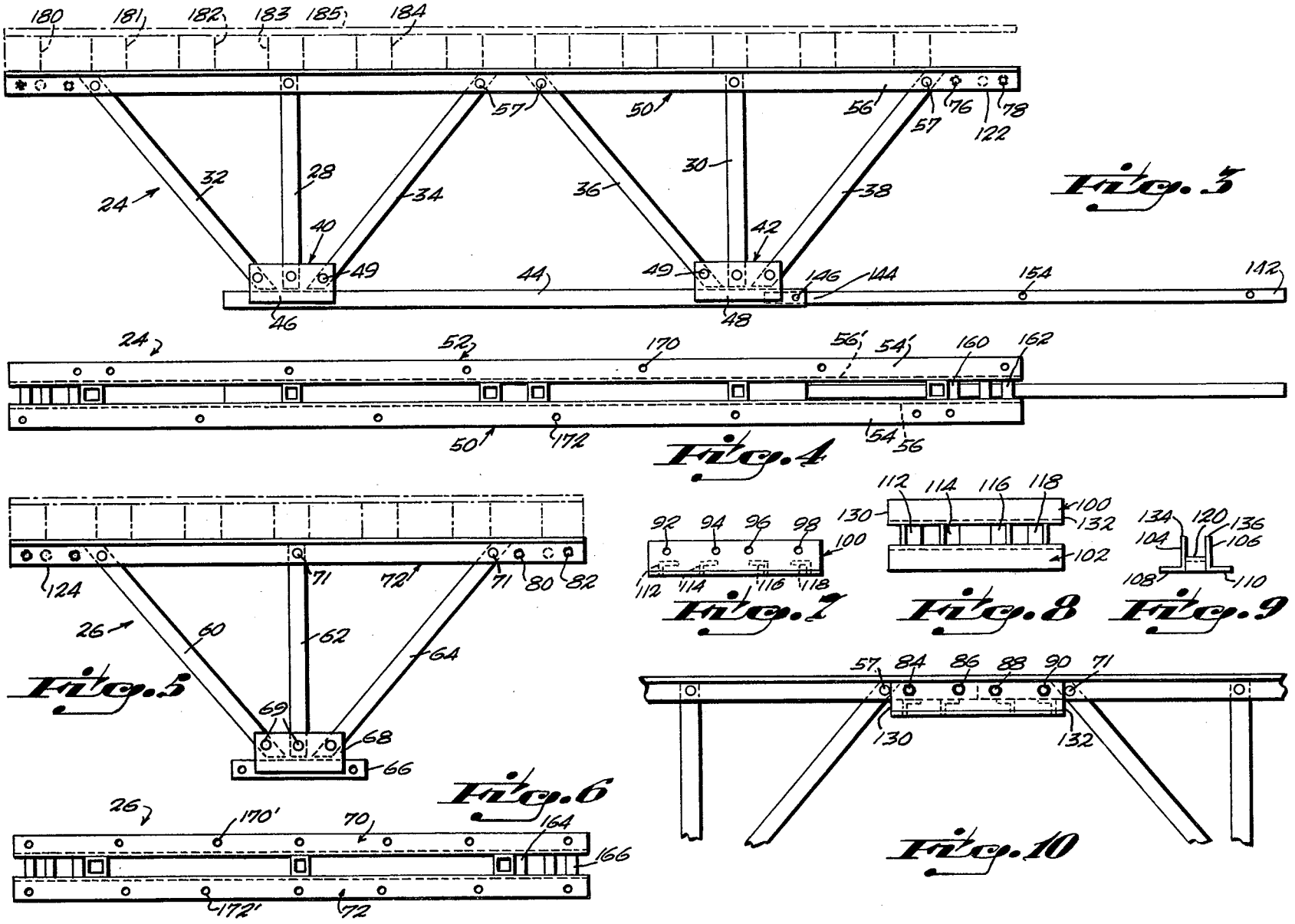
FIG. 3 is a side elevation view of a truss structure incorporating the instant invention.
FIG. 4 is a plan view of FIG. 3.
FIG. 5 is a view similar to FIG. 3 and illustrating an alternative embodiment.
FIG. 6 is a plan view of FIG. 5.
FIGS. 7, 8 and 9 are respectively side elevation, plan and end views of a connector for use in interconnecting portions assembled in accordance with the instant invention.
FIG. 10 is a view illustrating the use of the connector member shown in FIGS. 7, 8 and 9.

Desirably, the trusses of the skeletal framework are of two sizes, on to form light foot length units such as that designated by the numeral 24 and the other to form four foot high units such as that designated by the numeral 26 and shown in FIGS. 5 and 6.

Referring now to FIGS. 3 and 4, each of the trusses 24 include struts or members 28 and 30, 32 and 34, and 36 and 38. The struts 32 and 34 and 36 and 38 are arranged in a pair of commonly oriented spaced triangular force distribution patterns, the vertices 40 and 42 of which are spanned by a rigidifying member 44 and connected by bolts and plates 46 and 48 to the ends of the struts. Preferably the plates of each pair are fixed as by welding to the opposite sides of the rigidifying member and removably, but securely, bolted, as at 49, to the ends of the load-crrying members. Preferably the rigidifying member 44 is of tubular steel stock of square cross section. The diverging ends of the struts, that is, the struts 32 and 34 and 36 and 38, and the ends of the parallel struts 28 and 30 of each triangular force distribution pattern, are of a length such as to define a common support plane as indicated in FIG. 3 and are tied together by a pair of spaced angle pieces 50 and 52. Each of the angle pieces includes a first and a second flange 54 and 56 and 54' and 56'. The first flanges 54 and 54' of each pair are coplanar with respect to one another and define an abutment or support surface so that adjacent trusses are adapted to be interconnected by the panel structure 12 and 13, as is shown in FIG. 1. The second flanges 56 and 56' are removably, but normally tightly bolted as at 57 to the spaced ends of the struts or load-bearing members as seen in FIGS. 3 and 4. It is thus seen that the upper ends of the struts are clamped by the angle pieces; and that the lower ends are clamped by the plates 46 and 48 forming the trusses.

The truss of FIGS. 5 and 6 is somewhat similar to the truss described on reference to FIGS. 3 and 4. Preferably, instead of being 8 feet in overall length, the truss shown in FIG. 4 is about 4 feet in length. It includes strut members 60, 62 and 64, which are connected together at one of their ends by the rigidifying member 66 utilizing a pair of plates, 68 fixed to the rigidifying member by bolt means 69 connecting the ends of the struts to the plates. The other ends of the struts 60, 62 and 64 are connected by a pair of spaced angle pieces 70 and 72, each of which has flanges oriented similarly to that described on reference to FIGS. 3 and 4 and which are bolted to the struts as at 71.

It is thus seen that the trusses, whether the relatively long trusses of FIG. 3 or the relatively short trusses of FIG. 6 are adapted to be disassembled if desired, for shipment and are adapted to be readily assembled at a job site so that the struts are clampingly engaged and securely fastened by bolts between the plates and the angle pieces defining a sturdy truss structure.

To form a twelve foot high unit, each of the longer trusses of FIGS. 3 and 4 are adapted to be connected to a truss of the type shown in FIGS. 5 and 6. To this end, connector means are provided which will now be explained on reference to FIG. 10, and also with reference to FIGS. 7, 8 and 9. The connector means connect to the truss-like structures by means of bolts through a pair of aligned holes 76 and 78, in the case of the longer truss, and 80 and 82, in the case of the shorter truss. These holes are provided in the flange of each of the angle pieces. These holes accommodate bolts 84, 86, 88 and 90 which are passed through companionately spaced holes 92 and 94 and 96 and 98 in the connector member. The preferred structure of the connector members is as follows. A pair of spaced parallel angle pieces 100 and 102 are provided, each having a flange 104 and 106 arranged in spaced parallel relation to one another and each having an outer outturned flange 108 and 110. The angle pieces of the connector are held in spaced relation by spacer means 112, 114, 116, and 118 which are preferably short, stubby pieces of angle bar each having a flange arranged in coplanar relation with respect to one another and defining a support plane 120 to receive the edge 122 and 124 of the flange pieces of the trusses. Thus, it is seen that the connector member defines a socket to nest or receive the ends of the truss angle pieces for connecting trusses together in a rigid structure. Preferably, the length of the connector between the ends 130 and 132 of the connector, is sized to fit closely between the bolts 57 and 71 with the edges 134 and 136 in abutting relation with the underside of the outturned flanges of the truss angle pieces to provide a very rigid connection joint.

Figure 12:
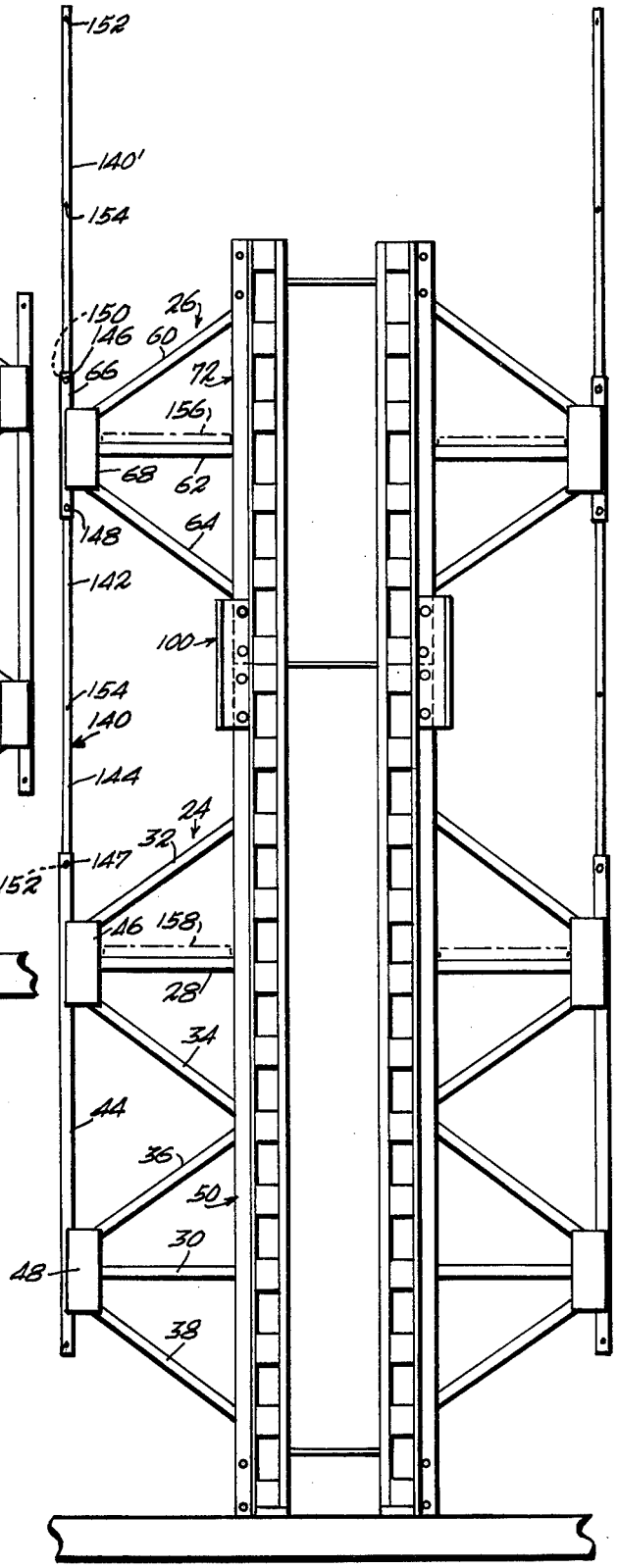
FIG. 12 is a view similar to FIG. 11 and illustrating the units of the instant invention in assembly for erecting a higher wall than that shown in FIG. 11.

The trusses are preferably of steel; however, other materials may be used. As seen in FIG. 12, when two trusses are connected together for a high wall pour, the rigidifying members of adjacent trusses are connected together by a rigid rod 140 as will now be explained. The rigidifying members 44 and 66, which are preferably of tubular stock of square cross section; are sized to receive the ends of the rod 140 in telescoped relation. Each rod 140 is of a length such that in assembly, its upper and lower ends 142 and 144 are receivable in the column of the associated rigidifying member. The rods are bolted in place as at 146 in FIG. 3. See also at 147 and 148 in FIG. 12. For this purpose, the rods are provided with holes 150 and 152 at predetermined locations. Also, as seenin FIGS. 3 and 12, a hole 154 is provided intermediate the rod length for passage of a safety line between the bars of adjacent trusses to provide a safety railing for workmen to stand or walk on planks 156 and 158 shown in dotted lines in FIG. 12. The rod 140', when used as shown in FIG. 12, becomes a port for a railing. Preferably to connect the angle pieces of the trusses together, cylindrical spacer members 160, 162 and 164 and 166 are provided about each of the bolts to distribute the load upon tightening over an enlarged area of the flange surface of the angle pieces. This is especially desirable when the trusses are of aluminum.

The platform structure which is assembled with a plurality of trusses to form a wall unit will now be described on reference to FIG. 1 as well as FIGS. 4 and 6. The outturned flanges of the trusses are provided with space holes 170, 172 and 170' and 172' therealong to which are bolted heavy spanners or beams 180, 181, 182, 183, 184, etc., which tie the trusses together into the skeletal framework of the unit. Over the beams a sheet of planar material 185 is attached. The sheet may be of plywood nailed to the braces which may be 4 × 4 timber lengths.

Figure 11:
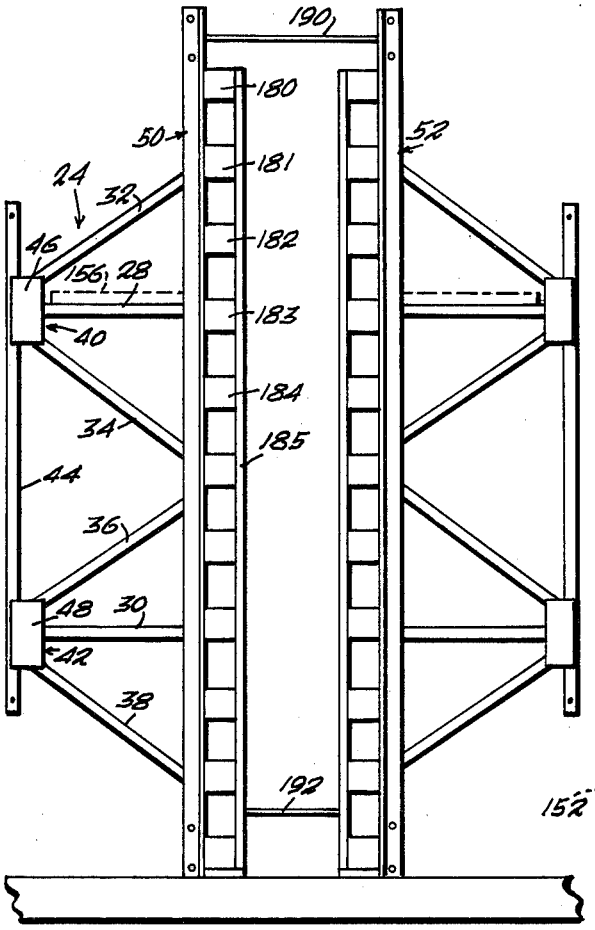
FIG. 11 is a side elevation view illustrating a pair of the truss structures arranged for use in pouring a wall.

Pair of the units, each of which may be readily assembled at a job site, are then erected as shown in FIG. 1 for the pour. As shown in FIG. 11, spacer members 190 and 192 between the units of a pair are preferably used.

Figure 14:
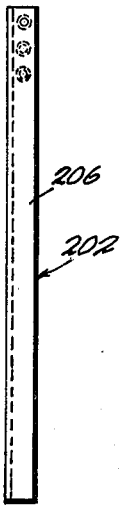
FIGS. 14 and 15 are side elevation and front elevation views respectively of a connector member used for use with the instant invention.
Figure 15:
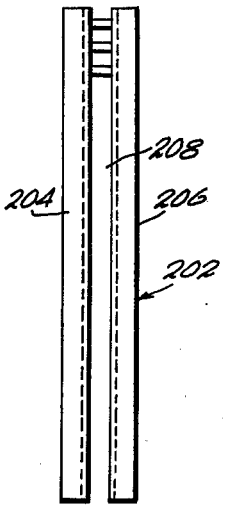
Figure 13:
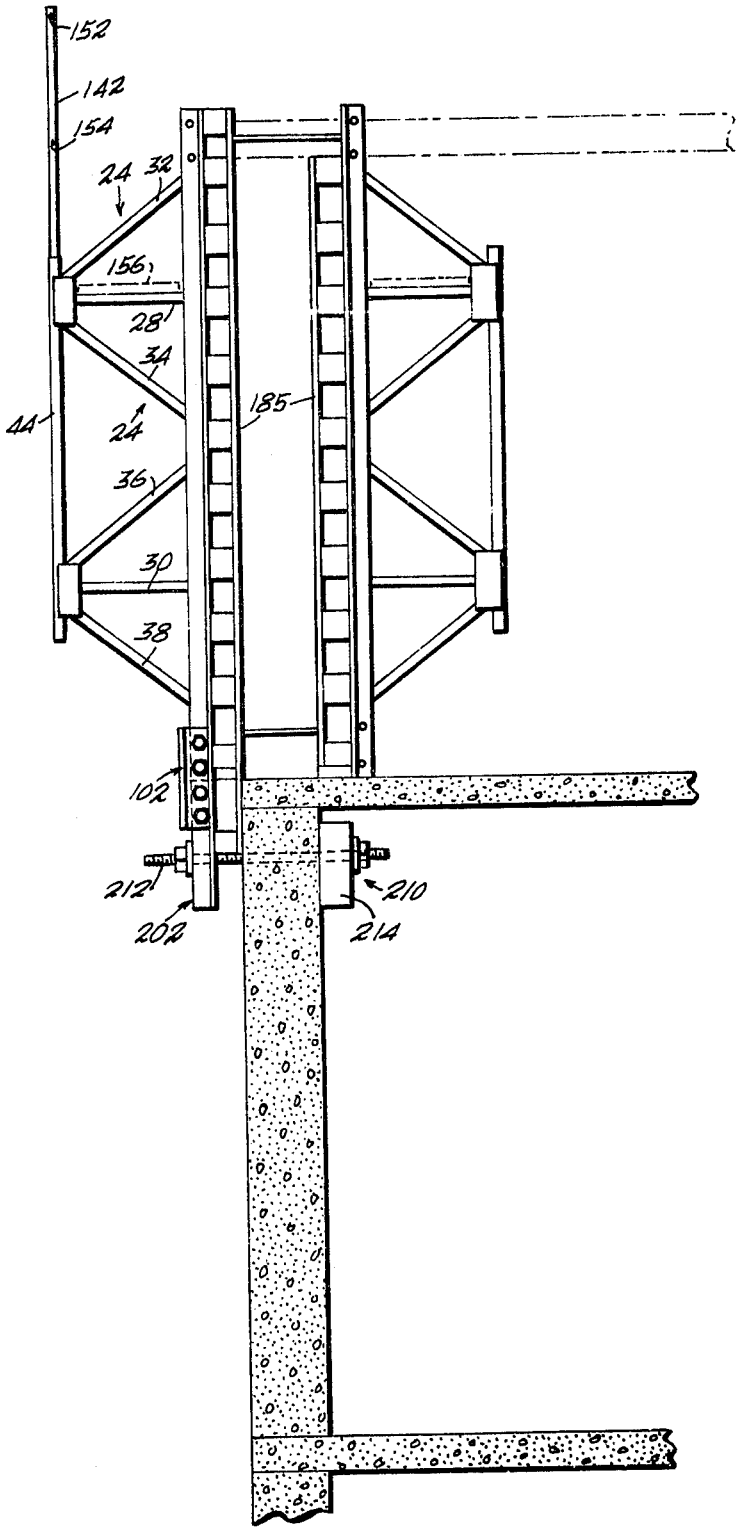
FIG. 13 is a view similar to FIG. 11 and illustrating the use of the invention in erecting an upper story of a building.

The units may be positioned on a slab or foundation for a ground floor wall; or they may be used to pour the wall of an upper story. In the latter event, the lower end of one of the units is supported on the upper floor inside the building and the other unit is supported by the wall as shown in FIG. 13. Utilizing the connector means previously described, the lower end of the trusses are connected to an attachment extension, see FIGS. 14 and 15. Each comprises a length 202 composed of spaced angle bars 204 and 206 defining a slot 208. The lengths are attached to the trusses by means of the connector means and the unit thus assembled is clamped by the clamp means 210 to the exterior of the wall of a building. The clamp means comprises a through bolt 212 which includes a pad 214 on the inner end.

What is claimed is:

1. For use with a generally planar wall form for use in a wall construction, a plurality of commonly aligned trusses, wherein each truss comprises:

an elongate main support, a rigidifying member spaced from said support and parallel thereto, a plurality of struts each having a first end and a second end and said struts interconnecting said main support and member defining a framework, said struts including a strut perpendicular to the support and to the member, and means to connect the first end of said perpendicular strut to the support and the second end of said perpendicular strut to the member, and a first strut and a second strut, and means to connect the second ends of said first and second strut to the rigidifying member on opposite sides of said perpendicular strut at its connection to the rigidifying member, and means to connect the first ends of first and second struts to the main support in spaced relation and on opposite sides of the connection of said perpendicular strut to said main support, said first and second struts being in a common plane with said perpendicular strut and extending from said rigidifying member and diverging with respect to one another and to the perpendicular strut toward the main support, said main support having a support surface facing away from said rigidifying member and including holes through said support surface for connection to the generally planar wall form, whereby the wall form when spanning a plurality of the commonly aligned trusses, a wall construction unit is defined;

said main support includes:

a first and a second spaced parallel member of rigid material each having a support surface in a common first plane and a pair of parallel spaced clamp surfaces in generally right-angular relation to the first plane, and extending toward said rigidifying member; and the first ends of said struts at said main support being sized for snug receipt between said clamp surfaces and, said means to connect tightly clamping the first ends of said struts between said clamp surfaces;

said means to connect the second ends of said struts to the rigidifying member comprises a pair of plates, one of the plates of the pair being on each side of said rigidifying member and defining a slot and one of the second ends of each of said struts being in said slot at said rigidifying member, and said means to connect clampingly engaging the ends of said struts between said plates and in said slot.

2. The device as set forth in claim 1 in combination with a plurality of similarly constructed trusses each arranged in parallel spaced relation and a generally planar wall form comprising a plurality of members spanning the main supports of the trusses defining a wall form construction grid and an outer sheet of planar material secured to said members spanning said main supports of said trusses.

3. The device as set forth in claim 1 wherein said rigidifying member is tubular and includes a rod with a first end telescoped in said tubular member and a portion extending outwardly therefrom and including means to connect the first end of said rod into telescoped relation in said rigidifying member and said rod having holes therethrough in said portion for accommodating passage of a line to form a safety rail.

4. The device as set forth in claim 1 wherein said struts are of tubular material.

5. The device as set forth in claim 4 wherein said truss includes a second perpendicular strut parallel to said first mentioned perpendicular strut and in spaced relation therefrom, means to connect said second perpendicular strut to the support member, a third strut and a fourth strut, means to connect the third strut and the fourth strut to the rigidifying member on opposite sides of said second perpendicular strut, said third and fourth struts extending in diverging relation with respect to one another and the second mentioned perpendicular strut to the main support, means to connect the third and fourth struts to the main support on opposite sides and in spaced relation from the means to connect the strut to the main support.

6. A pair of commonly aligned trusses as set forth in claim 1 and means to connect the trusses in parallel, commonly aligned, co-planar relation comprising a connector member, said connector member including a pair of spaced parallel members, comprising adjacent flanges and defining a socket therebetween, sized to receive a portion of the main support and means to connect the connector member to the main support of adjacent trusses with the main support of the adjacent trusses in abutting relation and between said flanges.

7. The device as set forth in claim 6 wherein said connector means includes support means laterally extending between the members to support the main support in assembly of the connector members to the main support and means are provided to connect the rigidifying members of adjacent truss members together.

* * * * *